US006267087B1

(12) United States Patent
Takahashi et al.

(10) Patent No.: US 6,267,087 B1
(45) Date of Patent: Jul. 31, 2001

(54) WATER-COOLED ENGINE

(75) Inventors: Katsunori Takahashi; Eiko Shiozaki; Tohru Ohshita, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/395,374

(22) Filed: Sep. 14, 1998

(30) Foreign Application Priority Data

Sep. 14, 1998 (JP) ..... 10-279422

(51) Int. Cl.[7] ..... F01P 5/10
(52) U.S. Cl. ..... 123/41.44; 123/41.09
(58) Field of Search ..... 123/41.44, 41.1, 123/41.29, 41.31, 41.55, 41.08, 41.09

(56) References Cited

U.S. PATENT DOCUMENTS 4,399,776 * 8/1983 Shikata ..... 123/41.08
4,545,333 * 10/1985 Nagumo et al. ..... 123/41.02
5,022,354 * 6/1991 Okita et al. ..... 123/41.1
5,503,118 * 4/1996 Hollis ..... 123/41.44
5,715,776 * 2/1998 Seidl ..... 123/41.1

FOREIGN PATENT DOCUMENTS

Y28-5326 2/1996 (JP) .

* cited by examiner

*Primary Examiner*—Willis R. Wolfe
*Assistant Examiner*—Katrina B. Harris
(74) *Attorney, Agent, or Firm*—Birch, Stewart, Kolasch & Birch, LLP

(57) ABSTRACT

A water pump is provided on one lower side of a crankcase and connected to a water jacket on the rear surface of the cylinder block through a water hose. The outlet section of the water jacket is connected to the thermostat case near this connecting section. The thermostat valve is a bottom bypass type thermostat valve, directly attached to the rear surface of the cylinder head. The bypass hose is connected to the water pump and passes along the side of a starter motor and passes between the starter motor and a speed sensor. The arrangement of the bypass hose in a bottom bypass type thermostat valve effectively utilizes space.

12 Claims, 2 Drawing Sheets

WATER-COOLED ENGINE

BACKGROUND OF THE INVENTION

1. Field of the Invention

The present invention relates to a water-cooled engine, and more particularly, to a piping structure between a water pump and a thermostat valve.

2. Description of the Background Art

A water-cooled engine has a cooling system including a water jacket, a thermostat valve, a radiator, and a water pump, with water hoses extending therebetween. Moreover, such a structure is known where a bottom bypass type thermostat valve is utilized such that the thermostat valve and the water pump are connected with a bypass hose, and cooling water is returned from the thermostat valve to the water pump when the temperature of the water is low. One example is shown in Japanese Utility Model Publication No. 8-5326.

Generally, in a single cylinder engine or parallel multi-cylinder engine, a thermostat and a carburetor are disposed within a space above a crankcase, which is provided close to a cylinder. Moreover, a starter motor is provided above the crankcase. Further, a water pump is provided under the crankcase.

Therefore, a space for adjusting the carburetor tends to be reduced because of water hoses that interconnect the thermostat valve, water pump, water jacket, and radiator. Further, the number of hoses increases when a bottom-bypass-type thermostat valve is used. Thus, it is difficult to create a space for such hoses without affecting the layout of other parts which are provided nearby.

SUMMARY OF THE INVENTION

It is an object of the invention to solve the above problems. In the present invention, the water piping connected between the rear surface of the engine and the water pump without passing over the upper part of the starter motor. This arrangement makes it possible to effectively utilize the space over the starter motor, thereby making the work of adjusting the carburetor easier.

The water hose passing between the outlet of the thermostat and the water pump passes through the plane of projection in the axial direction of the starter motor so that it is possible to position the water piping along the crankcase. With the piping positioned on the depth side of the starter motor as viewed from the water pump, the appearance is improved.

A sensor for measuring the vehicle speed is arranged on the upper surface of the crankcase. The water piping crosses in front of this sensor, thereby making it possible to effectively utilize the space between the starter motor and the sensor.

A thermostat case is directly attached on the air intake port side of the cylinder head of the engine so that it is possible to make the communication passage between the cylinder head and the thermostat case shorter, thereby simplifying the water piping path.

The water hose may be a bypass hose for the bottom bypass-type thermostat case so that, even in a bottom bypass-type cooling system with many pipes, it is possible to effectively utilize the space when laying pipes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
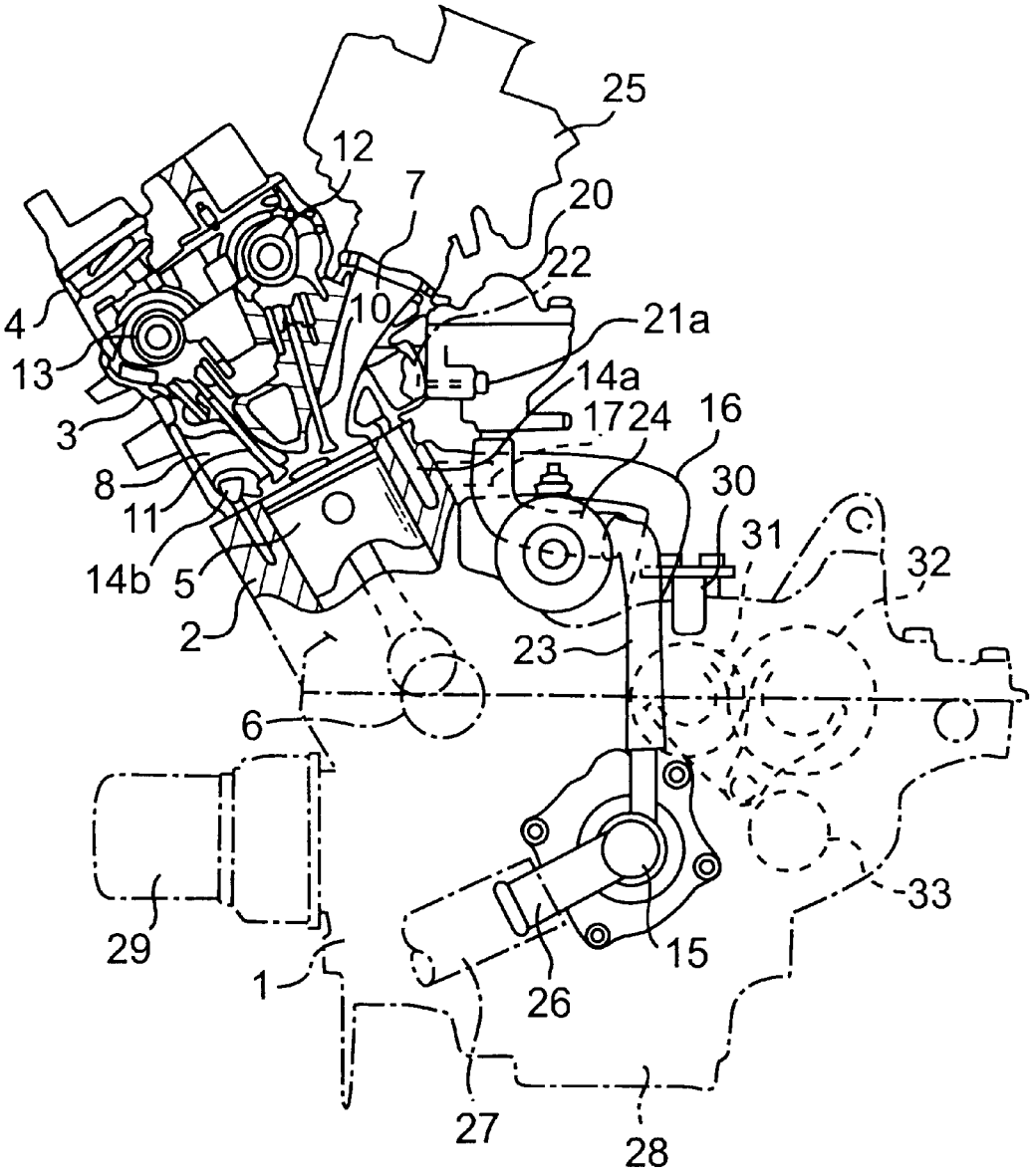
FIG. 1 is an external view of the engine for a motorcycle to which this embodiment of the invention is applied.

An embodiment of the invention applied to an in-line multi-cylinder engine for a motorcycle is described with reference to the drawings. First, the structure of the engine is briefly described with reference to FIG. 1. This engine is a dual overhead camshaft (DOHC) water-cooled four-cycle engine with a crankcase 1, a cylinder block 2, a cylinder head 3, and a cylinder head cover 4.

A piston 5 is located within the a cylinder of the cylinder block 2 and is freely slidable therein. The piston 5 is connected to a crankshaft 6 in the crankcase 1. A combustion chamber is formed between the piston 5 and the cylinder block 2, as well as the cylinder head 3.

An air intake port 7 and an exhaust port 8 communicating with this combustion chamber are provided on the cylinder head 3, and are opened and closed by an air intake valve 10 and an exhaust valve 11. The air intake valve 10 and exhaust valve 11 are driven by cams on camshafts 12, 13 that rotate synchronously with the crankshaft 6.

A water jacket 14*a* is provided in the cylinder block 2, and a water jacket 14*b* is provided in the cylinder head 3. Cooling water is supplied from a water pump 15 to an inlet of the water jacket 14*a* through a connecting pipe 17 provided on the rear surface of the cylinder block 2 via a water hose 16.

Cooling water heated while circulating through the water jackets 14*a*, 14*b* is fed through a thermostat case 20 to a radiator 35 arranged in front of the engine. A thermostat valve is located in the thermostat case 20 that is attached on the rear surface of the cylinder head 3, and again cooled here to be circulated to the water pump 15. The thermostat case 20 is directly attached by a bolt 21*a* at the joint section formed as one piece to the cooling water outlet section 22 of the water jacket 14 located on the rear surface of the cylinder block 2 near the air intake port 7. The cooling water having finished the cooling directly flows from the outlet section 22 into the thermostat case 20 without passing through the water hose.

The thermostat valve is a bottom bypass type thermostat valve provided with a bypass circuit having a bypass hose 23 connected to the water pump 15 so that when the temperature of the water is less than a specified temperature, the thermostat valve is switched to the bypass circuit side so that the cooling water heated by the engine is not fed to the radiator but is directly returned to the water pump 15 from the bypass hose 23.

A starter motor 24 is provided under the thermostat case 20 and near the rear surface of the cylinder block 2, as well as on the upper surface of the crankcase 1. A carburetor 25 is arranged in the space in the rear of the back surface of the cylinder head 3 located over and near the thermostat case 20.

Numeral 26 in the drawings indicates a suction pipe with which the cooling water from the radiator is supplied through the water hose 27. Numeral 28 indicates an oil pan, numeral 29 indicates an oil filter, and numeral 30 indicates a speed sensor for the transmission to be provided on the main shaft 31 of the transmission. Numeral 32 indicates a counter shaft, and numeral 33 indicates a shift drum.

Figure 2:
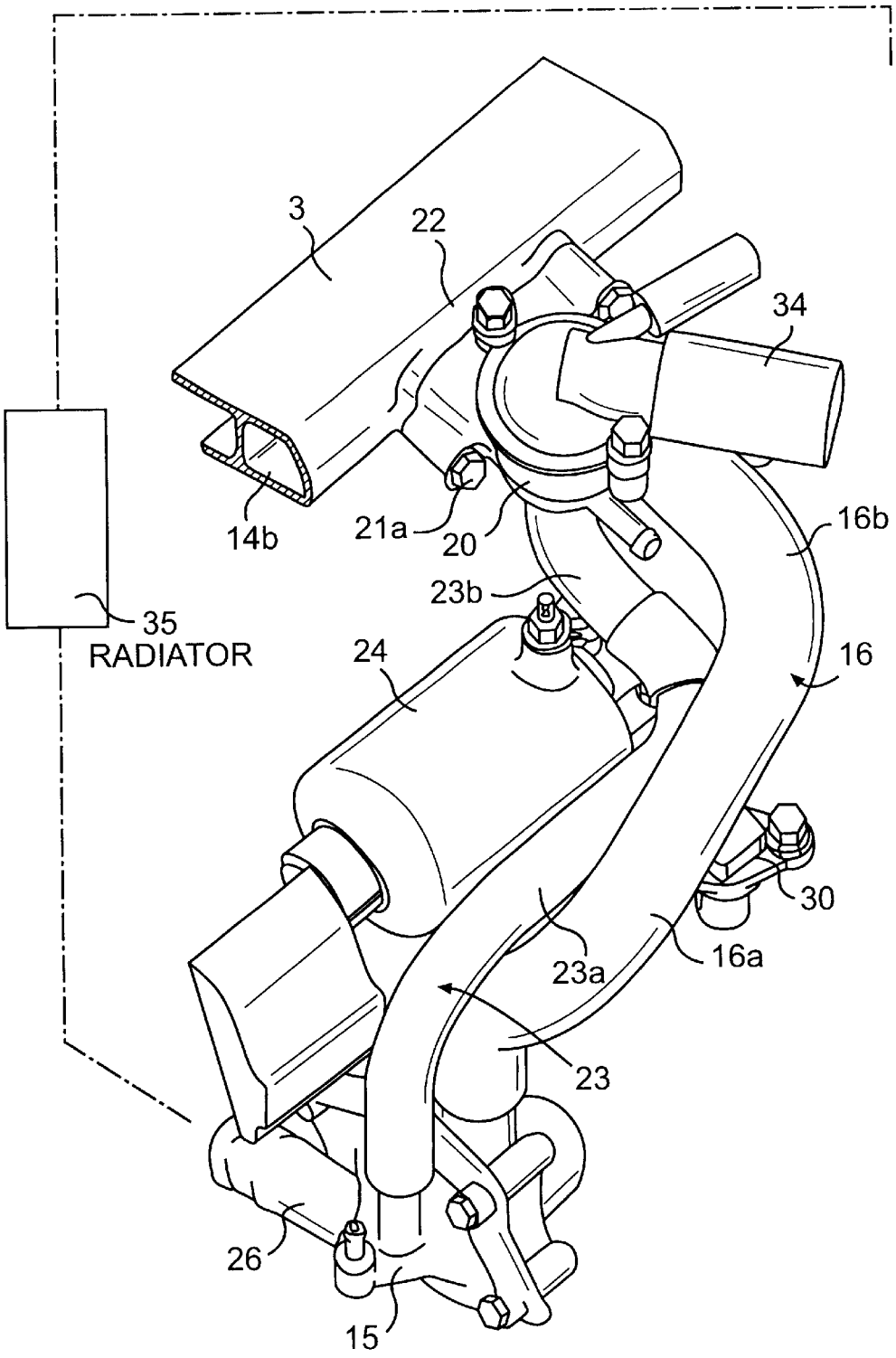
FIG. 2 is a view showing the structure of the water piping around the thermostat valve.

As clearly shown in the FIG. 2, the water hose 16 and the bypass hose 23 extend upwardly from the water pump 15, and bend in the transverse direction of the vehicle at the rear of the starter motor 24. The water hose 16 and the bypass hose 23 form a crossing section 16*a*, 23*a* extending parallel in the axial direction of the starter motor 24, and form a longitudinal section 16*b*, 23*b* that bends forwardly at a point past the end of the starter motor 24.

Therefore, the water hose 16 and bypass hose 23 pass beside the starter motor 24 without passing over the top of the starter motor 24. The bypass hose 23 passes through a projection plane in the axial direction of the starter motor 24 (Refer to FIG. 1). Moreover, the crossing section 23*a* passes over the top of the speed sensor 30, and the crossing section 23*b* passes over the front part.

Numeral 34 indicates a return hose from the thermostat case 20, and, if the temperature of the cooling water increases over a specified temperature, the bypass circuit is closed to return the cooling water from the return hose 34 to the radiator 35.

The effects of this example are described hereafter. The water hose 16 and the bypass hose 23 connecting the water pump 15 and the thermostat case 20 pass beside the side without passing over the starter motor 24 so that it is possible to effectively utilize the space over the starter motor 24. Further, no water hose passes under and near the carburetor 25, thereby making adjustment easier. Furthermore, it is possible to lay the water piping over and along the crankcase 1 and make it pass through the depth side of the starter motor 24 viewed from the water pump side, thereby improving the appearance.

The thermostat case 20 is directly attached near the air intake port 7 being at a rear side of the cylinder head 3 of the engine so that it is possible to make the water passage between the cylinder head 3 and the thermostat case 20 short, thereby also making it possible to simplify the water piping. In addition, even if the engine has a structure where the length of a bypass hose 23 tends to increase, it is possible to lay a bypass hose 23 while effectively utilizing the space around the starter motor 24 by using a bottom bypass type thermostat valve.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A water-cooled engine comprising:

a crankcase;

a cylinder block attached to the crankcase;

a starter motor arranged on a rear surface of the crankcase; and a water pump arranged on the crankcase, wherein water piping connected between a rear surface of the cylinder block and the water pump is laid beside the starter motor.

2. The water-cooled engine of claim 1, wherein a water hose passing between an outlet of a thermostat and the water pump passes through a plane of projection in the axial direction of said starter motor.

3. The water-cooled engine of claim 1, wherein a sensor for measuring vehicle speed is arranged on an upper surface of said crankcase, and said water piping crosses in front of the sensor.

4. The water-cooled engine of claim 1, wherein a thermostat case is directly attached on an air intake port side of a cylinder head of said engine.

5. The water-cooled engine of claim 4, wherein said water piping includes a bypass hose connected to a bypass outlet provided on the thermostat case which includes a bottom-bypass thermostat valve.

6. A water-cooled engine comprising:

a crankcase;

a cylinder block attached to said crankcase, said cylinder block having a block water jacket therein, said cylinder block having a block opening therein in communication with said block water jacket;

a cylinder head attached to said cylinder block, said cylinder head having a head water jacket therein, said cylinder head having a head opening therein in communication with said head water jacket, said head water jacket being in communication with said block water jacket;

a starter motor attached to a rear surface of said crankcase;

a water pump attached to said cylinder block, said water pump including a first port and a second port;

a first water pipe connected between said first port of said water pump and said block opening; and a second water pipe connected between said second port of said water pump and said head opening, said second water pipe passing along one side of said starter motor and beside a rear end of said starter motor, wherein neither of said first and second water pipes passes over an upper surface of said starter motor.

7. The water-cooled engine according to claim 6, further comprising a thermostat case attached to one of said cylinder block and said cylinder head, said thermostat case having a thermostat therein for controlling a flow of water through said thermostat case.

8. The water-cooled engine according to claim 7, wherein said thermostat case is attached to said head opening of said cylinder head.

9. The water-cooled engine according to claim 8, wherein said first water pipe supplies water from said water pump to said block water jacket of said cylinder block.

10. The water-cooled engine according to claim 9, wherein said second water pipe is a radiator bypass pipe which returns water from said head water jacket of said cylinder head to said water pump.

11. The water-cooled engine according to claim 6, wherein said first water pipe supplies water from said water pump to said block water jacket of said cylinder block.

12. The water-cooled engine according to claim 6, wherein said second water pipe is a radiator bypass pipe which returns water from said head water jacket of said cylinder head to said water pump.

* * * * *